United States Patent [19]

Martell et al.

[11] 4,404,919

[45] Sep. 20, 1983

[54] CONTROL SYSTEM FOR PROVIDING STITCH LENGTH CONTROL OF A SEWING MACHINE

[75] Inventors: Charles R. Martell; Elmer N. Leslie; Don D. Isett, all of Dallas; Stephen S. Treadwell, Richardson, all of Tex.

[73] Assignee: Microdynamics, Inc., Dallas, Tex.

[21] Appl. No.: 278,674

[22] Filed: Jun. 29, 1981

Related U.S. Application Data

[63] Continuation-in-part of Ser. No. 210,197, Nov. 26, 1980, which is a continuation-in-part of Ser. No. 168,525, Jul. 14, 1980, Pat. No. 4,359,953.

[51] Int. Cl.[3] ..... D05B 19/00

[52] U.S. Cl. ..... 112/121.11; 112/262.1; 112/315; 112/272

[58] Field of Search ..... 112/121.11, 121.12, 112/275, 277, 315, 316, 317, 2, 272, 262.1

[56] References Cited

U.S. PATENT DOCUMENTS

| | | | |
|---|---|---|---|
| 3,808,995 | 5/1974 | Dobner et al. . | |
| 4,154,179 | 5/1979 | Arnold . | |
| 4,226,197 | 10/1980 | Pollmeier et al. | 112/121.11 |
| 4,359,953 | 11/1982 | Martell et al. | 112/121.11 |

FOREIGN PATENT DOCUMENTS

| | | |
|---|---|---|
| 2007857 | 8/1969 | Fed. Rep. of Germany . |
| 2208409 | of 0000 | France . |
| 2231048 | of 0000 | France . |
| 53-38646 | of 0000 | Japan . |
| 1310091 | of 0000 | United Kingdom . |

*Primary Examiner*—Peter P. Nerbun
*Attorney, Agent, or Firm*—Jerry W. Mills

[57] ABSTRACT

An adaptive semiautomatic sewing system (10) comprises a sewing machine (12), a drive unit (42) including a variable speed motor and encoder for counting stitches sewn and for sensing the rotation of the motor, at least one material edge sensor (40) mounted ahead of the needle (22) of the sewing machine, and a microprocessor controller (51) coupled to the sewing machine controls. The system (10) has manual, teach and auto modes of operation. In the teach mode, control parameters for each seam are stored as the operator sews the initial piece. Accurate control of seam lengths and end points is achieved by initiating countdown of a variable number of final stitches responsive to detection of the material edges by the sensors (40). In dependence upon the amount of the stitch which has been sewn upon edge detection, the reverse lever (17) is moved against stop member (13) in order to reduce the length of the last stitch sewn in order to improve the accuracy of the seam end point.

29 Claims, 11 Drawing Figures

FIG. 1
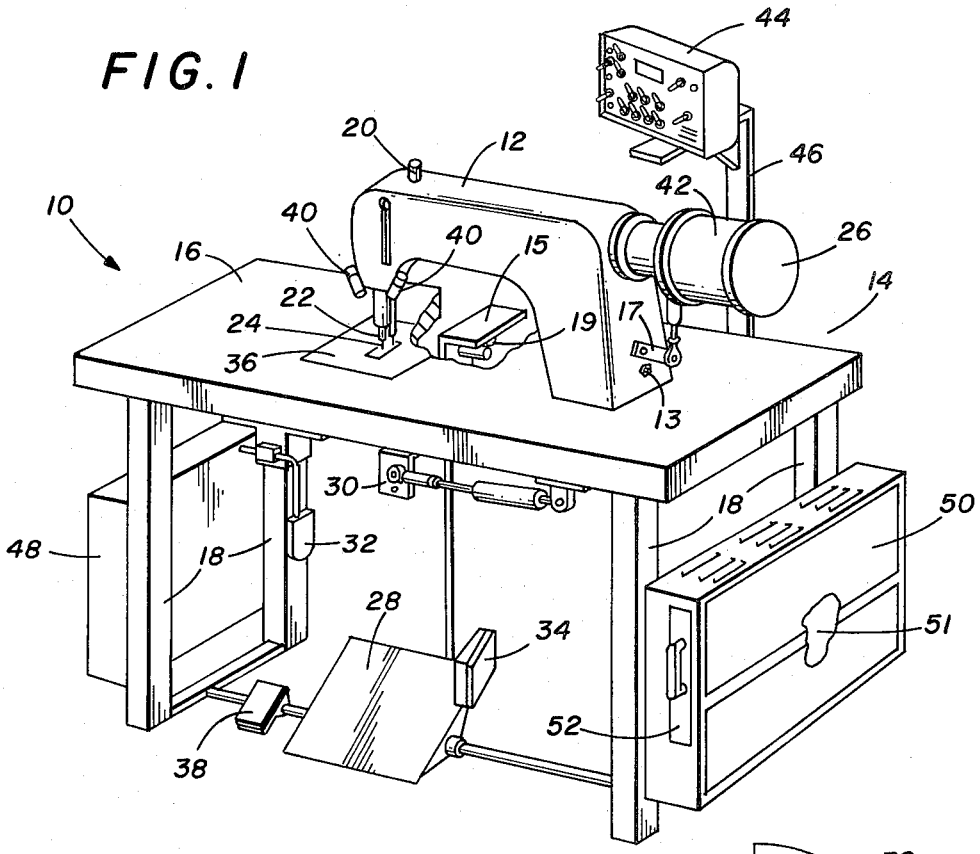
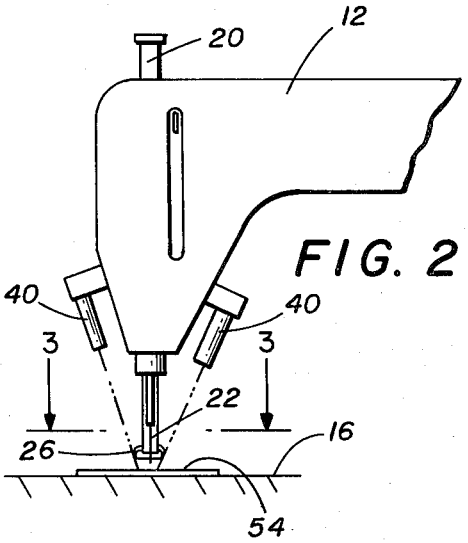
FIG. 2
FIG. 3
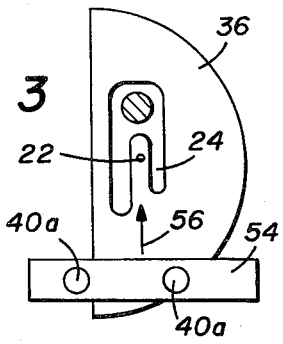
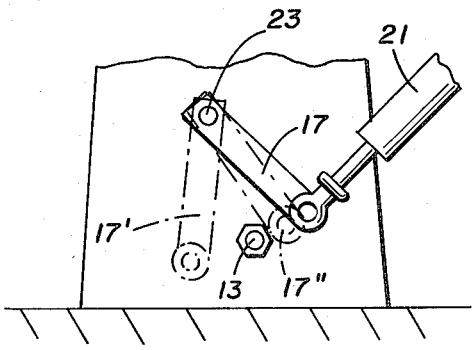
FIG. 4

CONTROL SYSTEM FOR PROVIDING STITCH LENGTH CONTROL OF A SEWING MACHINE

CROSS REFERENCE TO OTHER APPLICATIONS

This application is a continuation-in-part of patent application Ser. No. 210,197, filed on Nov. 26, 1980 and entitled "Control System for Sewing Machine", now pending, which is a continuation-in-part of patent application Ser. No. 168,525, filed July 4, 1980 and entitled "Control System For Sewing Machine", now U.S. Pat. No. 4,359,953.

TECHNICAL FIELD

The present invention relates generally to a control system to adapt a sewing machine for semi-automatic operation. More particularly, this invention is directed to an adaptive sewing machine control system incorporating a microprocessor controller in combination with a stitch counter, an edge sensor and stitch length control apparatus to achieve more precise seam lengths and end points.

BACKGROUND ART

In the sewn goods industry, where various sections of material are sewn together to fabricate products, reasonably precise seam lengths and/or end points are often necessary for proper appearance and function of the finished products. For example, the top stitch seam of a shirt collar must closely follow the contour of the collar and terminate at a precise point which matches with the opposite collar. In the construction of shoes, accurate seam lengths must be maintained when sewing together the vamps and quarter pieces to achieve strength as well as pleasing appearance. Seams with imprecise lengths and/or end points can result in unacceptable products or rejects, thus causing waste and further expense.

Achieving consistently accurate seam lengths and/or end points at high rates or production, however, has been a long standing problem in the industry. Sewing machines traditionally have been controlled by human operators. Rapid coordination of the operator's eyes, hands and feet is necessary to control a high speed industrial sewing machine. Considerable practice, skill and concentration are required to sew the same type of seam with consistent accuracy time and time again.

Since such sewing operations tend to be repetitive and, therefore, lend themselves to automation, systems have been developed heretofore for automatically controlling sewing machines. U.S. Pat. Nos. 4,108,090; 4,104,976; 4,100,865 and 4,092,937, assigned to the Singer Company, are representative of such devices. Each of these patents discloses a programmable sewing machine with three operational modes: manual, auto and learning. Control parameters are programmed into the system as the operator manually performs the initial sewing procedure for subsequent control of the sewing machine in the auto mode.

While these programmable sewing machines have several advantages over manually controlled machines, they are not without their disadvantages. The prior systems rely upon overall stitch counting to determine seam lengths and/or end points, variations in which can be caused by several factors. First, cloth or fabric is a relatively elastic material which can be stretched or contracted by the operator during the sewing procedure, thereby causing changes in average stitch lengths which can accumulate into a significant deviation over the length of a seam. Second, slippage can occur as the material is advanced between the presser foot and feed dog of the sewing machine, thereby causing further deviations in the length of the seam. Also, such slippage can vary in accordance with the speed of the sewing machine. Third, any deviations between the paths of the desired seams versus the paths of the seams as programmed can also contribute to inaccurate seam lengths. Variations in seam lengths become greatest with long seams and elastic material.

Thus, although the programmable sewing machines of the prior art offer higher speeds of operation, they have not been completely satisfactory in those applications where precise seam lengths and end points are required.

Another approach to the problem of stopping a sewing machine precisely and consistently at a given point was generally proposed in an article entitled "Fluidics for the Apparel Industry", *Journal of the Apparel Research Foundation,* Vol. 3, 1969. This article suggested that a sensor might be mounted in the presser foot of the sewing machine for sensing the edge of the material in order to initiate countdown of a preset number of stitches for stopping the machine at the desired point. This proposal, however, does not take into account the fact that edge conditions are dependent upon the seam and type of workpiece. No single preset number of stitches works well with pieces of different shapes or similar pieces of different sizes. As far as Applicants are aware, this proposal never has been embodied in a programmable sewing system.

U.S. patent application Ser. No. 168,525, filed July 14, 1980 and entitled "Control System for Sewing Machine" and Ser. No. 210,197, filed Nov. 26, 1980, and entitled "Control System for Sewing Machine", both assigned to assigner, disclose apparatus for improving the accuracy of seam lengths. However, even with the improved apparatus disclosed in these applications, the accuracy of the stitch length or seam end point is approximately $\pm\frac{1}{2}$ stitch length. For many garments, this accuracy is not satisfactory and may result in unacceptable visual defects, as for example, shirt collars which have uneven seam end points.

A need therefore has arisen for an improved adaptive sewing machine control system utilizing a combination of stitch counting, edge detection techniques and stitch length control to obtain more accurate seam lengths and/or end points.

SUMMARY OF INVENTION

The present invention comprises a sewing machine control system which substantially improves the seam length accuracy to $\pm\frac{1}{4}$ stitch length or better.

In accordance with the invention, there is provided a system including a microprocessor controller which can be programmed with a taught a sequence of sewing operations by the operator in one mode, while sewing the initial piece, for automatically controlling the machine during subsequent sewing of similar pieces of the same or different sizes in another mode. The semi-automatic system herein does not rely upon either pure stitch counting or material edge detection alone, but rather utilizes a combination of these techniques together with other features to achieve more accurate seam length and end point control. The present system further includes apparatus for varying the length of the last stitch sewn in order to improve the seam end point accuracy.

More specifically, this invention comprises a microprocessor-based control system for an industrial sewing machine. The system has manual, teach and auto modes of operation. In the preferred embodiment, one or more sensors are mounted in front of the presser foot for monitoring edge conditions of the material at the end of each seam. In the teach mode, operating parameters are programmed into the controller by the operator while manually sewing the first piece. For each seam, the number of stitches x sewn at the time of the last status change in the sensors, the sensor pattern after x stitches had been sewn, and the total number of stitches y sewn in the seam are recorded along with sewing machine and auxiliary control inputs. In the auto mode, the number of stitches sewn in each seam is monitored as the count passes a window set up around x until the characteristic sensor pattern including edge detection is seen, at which time y−x additional stitches are sewn to complete the seam. The amount of stitch completion at the time of detection of the material edge in monitored, and the reverse mechanism of the sewing machine is actuated in order to control the length of the last seam stitch to the desired length.

BRIEF DESCRIPTION OF DRAWINGS

A more complete understanding of the invention can be had by reference to the following Detailed Description taken in conjunction with the accompanying Drawing, wherein:

FIG. 1 is a perspective view of a programmable sewing system incorporating the invention;

FIG. 2 is a front view illustrating placement of the edge sensor relative to the sewing needle;

FIG. 3 is a sectional view taken along lines 3—3 of FIG. 2 in the direction of the arrows;

FIG. 4 is an end view of the sewing system illustrating the automatic control apparatus of the sewing machine reverse mechanism;

DETAILED DESCRIPTION

Figure 5:
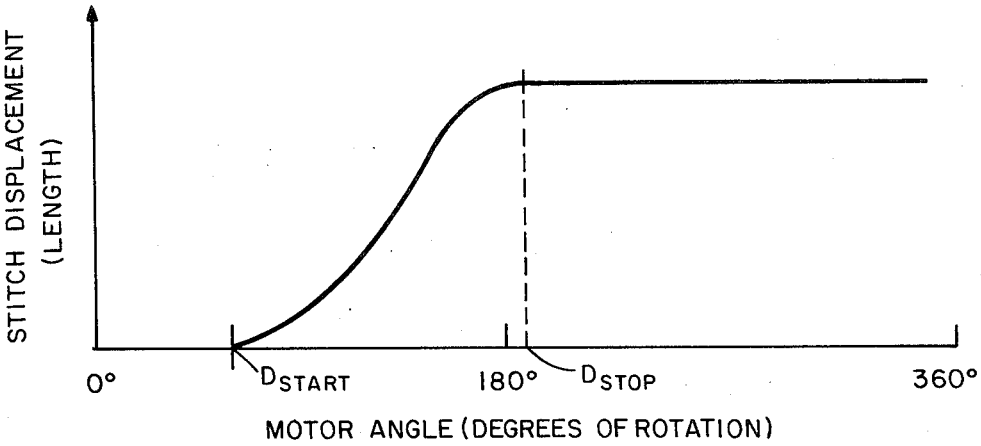
FIG. 5 is a graph illustrating the degrees of rotation of a sewing machine motor plotted against the length of a resulting stitch.

Referring now to the Drawings, wherein like reference numerals designate like or corresponding parts throughout the views, FIG. 1 illustrates a semi-automatic sewing system 10 incorporating the invention. System 10 is a microprocessor-based system adapted to extend the capabilities of a sewing machine by enabling the operator to perform sewing procedures on a manual or semi-automatic basis, as will be more fully explained hereinafter.

System 10 includes a conventional sewing machine 12 mounted on a work stand 14 consisting of a table top 16 supported by four legs 18. Sewing machine 12, which is of conventional construction, includes a spool 20 containing a supply of thread for stitching by a reciprocable needle 22 to form a seam in one or more pieces of material. Surrounding needle 22 is a vertically movable presser foot 24 for cooperation with movable feed dogs (not shown) positioned within table top 16 for feeding material past the needle.

A number of standard controls are associated with sewing machine 12 for use by the operator in controlling its functions. A handwheel 26 is attached to the drive shaft (not shown) of machine 12 for manually positioning needle 22 in the desired vertical position. Sewing speed is controlled by a speed sensor 15 which is actuated by a foot treadle 28, which functions like an accelerator. Vertical positioning of presser foot 24 can be controlled by heel pressure on foot treadle 28 which closes a switch 19 in speed sensor 15, which in turn causes the presser foot lift actuator 30 to operate. A leg switch 32 is provided for controlling the sewing direction of machine 12 by causing operation of reverse sew lever actuator 17. An important aspect of the present invention is the stop member 13 which prevents the reverse sew lever actuator 17 from being fully operated as will be subsequently described.

A toe switch 34 located adjacent to foot treadle 28 controls a conventional thread trimmer (not shown) disposed underneath the throat plate 36 of machine 12. Foot switch 38 on the other side of foot treadle 28 comprises a one-stitch switch for commanding machine 12 to sew a single stitch.

It will thus be understood that sewing machine 12 and its associated manual controls are of substantially conventional construction, and may be obtained from several commercial sources. For example, suitable sewing machines are available from Singer, Union Special, Pfaff, Consew, Juki, Columbia, Brother or Durkopp Companies.

In addition to the basic sewing machine 12 and its manual controls, system 10 includes several components for adapting the sewing machine for semi-automatic operation. One or more sensors 40 are mounted in laterally spaced-apart relationship in front of needle 22 and presser foot 24. A drive unit 42 comprising a variable speed direct drive motor, sensors for stitch counting and an electromagnetic brake for positioning of needle 22, is attached to the drive shaft of sewing machine 12. A main control panel 44 supported on a bracket 46 is provided above one corner of work stand 14.

On one side of work stand 14 there is a pneumatic control chassis 48 containing an air regulator, filter and lubricator for the sewing maching control sensors, pneumatic actuators and other elements of system 10. All of these components are of known construction and are similar to those shown in U.S. Pat. Nos. 4,108,090; 4,104,976; 4,100,865 and 4,092,937, the disclosures of which are incorporated herein by reference.

A controller chassis 50 is located on the opposite side of work stand 14 for housing the electronic components of system 10. Chassis 50 includes a microprocessor controller 51, appropriate circuitry for receiving signals from sensors and carrying control signals to actuators, and a power module for providing electrical power at the proper voltage levels to the various elements of system 10. The microprocessor controller 51 may comprise a Zilog Model Z-80 microprocessor or any suitable unit having a read only memory (ROM) and random access memory (RAM) of adequate storage capacities. An auxiliary control panel 52 is mounted for sliding movement in one end of chassis 50. Operation and function of the foregoing components will become more clear in the following paragraphs.

Referring now to FIGS. 2 and 3, further details of edge sensors 40 and their cooperation with needle 22 can be seen. If desired, only one edge sensor 40 can be used with sewing machine 12; however, complex shaped parts may require two or even three edge sensors located in laterally spaced-apart relationship in front of the needle. Sensors 40 can be mounted directly on the housing of sewing machine 12, or supported by other suitable means. As illustrated, each sensor 40 comprises a lamp/photosensor which projects a spot of light 40*a* onto a reflective tape strip 54 on throat plate 36. The status of each sensor 40 is either "on" or "off" depending upon whether the light beam thereof is interrupted, such as by passage of the trailing edge or discontinuity of the particular piece of material.

It will be appreciated that a significant feature of the present invention comprises usage of at least one and possibly a plurality of sensors 40 positioned in mutually spaced relationship ahead of needle 22 of sewing machine 12. Sensors 40 indicate whether or not the end of a particular seam is being approached. The condition of at least one sensor 40 changes as the trailing material edge passes thereunder to indicate approach of the seam end point. Sensors such as the Model 10-0672-02 available from Clinton Industries of Carlstadt, N.J., having been found satisfactory as sensors 40; however, infrared sensors and emitters, or pneumatic ports in combination with back pressure sensors could also be utilized, if desired. Any type of on/off sensor capable of detecting the pressure or absence of material a preset distance in front of needle 22 can be utilized with apparatus 10 since the exact mode of their operation is not critical to practice of the invention. Sensors 40 can be mounted directly on the housing of sewing machine 12 or on an adjustable mounting assembly.

Circuitry is provided in chassis 50 which detects the output of sensors 40 in order to generate electrical signals representative of the material edge. The controller 51 is responsive to such edge detection for allowing a selected number of stitches to be sewn after the edge detection. The controller 51 also determines the amount of the currently sewn stitch which has been completed at edge detection. The amount of the stitch is determined in response to the sewing machine motor rotation. In response to the amount of the stitch sewn at edge detection, the controller 51 controls the reverse mechanism of the machine in order to control the length of the last stitch sewn.

As described in the previously identified co-pending patent applications, the present system may first be operated in a teaching mode and thereafter operate in an automatic mode. The system may be taught in the teaching mode to sew x−y stitches after the material edge is detected. Thereafter, when the system is operated in the automatic mode, the edge of the material will be automatically detected by the sensor and the machine will then automatically sew x−y stitches and then terminate the seam. In this manner, automatic operation of the system may be provided in order to increase the speed and accuracy of the system without required human intervention. The present system operates is essentially the same manner as the systems described in the two co-pending patent applications, with additional improvements and accuracy being provided by the present invention as will be subsequently shown.

In operation of the system thus described, as a seam is sewn by the machine, the number of stitches from the starting point are counted by the encoder within drive unit 42. The reflective tape 54 will be covered by the material and the beams of the sensors 40 are blocked by the material. When the edge of the material moves past the reflective tape 54, the sensor beams are reflected from the reflective tape 54 and sensed. This provides the system with an indication of the location of the edge of the material. The system may then sew a predetermined number of stitches in order that the seam ends at a preselected location. In addition, auxiliary devices such as stackers, trimers, guides, and zig-zag lever actuators may be controlled in response to the material edge detection.

For a more detailed understanding and description of the operation of the system shown in FIGS. 1–3, reference is made to the co-pending patent applications Ser. Nos. 168,525 and 210,197, previously noted. The Specifications and Drawings of these applications are incorporated herein and may be referred to for a more detailed description of the operation of the system.

In the operation of the system described in copending patent applications Ser. Nos. 168,525 and 210,197, it was not possible to obtain accuracy better than plus or minus one-half stitch is determining the absolute end point of a seam. With the utilization of the present system to be described, accuracy in terminating a seam may be provided within plus or minus one-fourth stitch.

Referring to FIG. 4, an enlarged view of the reverse sew lever actuator assembly is illustrated. A pneumatic cylinder 1 is actuated in response to the leg switch 32 in order to pivot the reverse sew lever 17 about a pivot point 23. Alternatively, cylinder 21 may be actuated by a switch in chassis 48 as will be subsequently described. The lever 17 is illustrated in the solid line position in its normal operating position in the forward sew mode. When the cylinder 21 is actuated, the lever 17 is pivoted about pivot point 23 in order to place the machine in the reverse sew mode. Without the stop member 13, the lever 17 would normally be moved to the reverse sew mode as illustrated by the dotted line position 17'. However, because of the stop member 13, the lever 17 may only be moved to the dotted line position 17" adjacent the stop member 13. Consequently, according to the present invention, the reverse sew lever actuator is limited to approximately one-quarter its normal movement. This enables the sewing operation of the machine to be controlled to a greater accuracy then without the stop member 13.

FIG. 5 is a graph illustrating the length of a stitch displacement versus the rotation of the motor of the sewing machine. In an industrial sewing machine, the transport mechanism comprises a feed dog and presser foot. The amount by which the material being sewn is advanced for each stitch, termed stitch length, can be controlled by mechanical adjustments on the sewing machine. FIG. 5 illustrates the interval over 360° rotation of the sewing machine motor during which the stitch formation occurs. The interval over which the stitch formation occurs varies depending upon the machine type, such as drop feed, needle feed, top feed and the like. FIG. 5 illustrates material advancement over approximately 120° of the motor rotation of a typical sewing machine such as shown in FIG. 1. As shown in FIG. 5, the stitch is not begun until the motor has rotated approximately 60°. The stitch is then formed until it is completed after the sewing machine motor has completed approximately 180° rotation. The last 180° rotation of the sewing machine motor enables the machine to ready for the formation of the next stitch. The interval of the motor rotation is dynamically detected by the controller 51 over which stitch formation occurs, in order to determine the percentage of the stitch completed at edge detection.

FIGS. *6a–6c* illustrate the operation of prior art devices such as are exemplified by the stitch controllers disclosed in Ser. Nos. 168,525 and 210,197, previously noted. FIG. *6a* illustrates the sewing of a seam comprising a number of stitches utilizing a conventional sewing machine. In the example shown in FIG. *6a*, the seam was started at the correct location relative to the material edge so that the end of the last stitch occurred exactly on the desired offset from the material edge. For example, if it were desired to end the seam one-quarter inch from the material edge, the operation shown in FIG. *6a* was such that the seam ended exactly one-quarter inch from the material edge.

FIG. *6b* illustrates the operation of a prior art device wherein the seam was started too close to the material edge, or wherein problems in material compaction or stretch occurred. Thus, the seam ended approximately one-half stitch past the desired offset from the material edge. If in the above example, the stitch length was $\frac{1}{4}$ inch, the seam would end approximately one-eighth inch from the material edge, rather than the desired one-quarter inch from the material edge. It will be understood that it is not always possible to begin a seam at the exact desired position, and thus provisions must be made to end the seam as closely as possible to the desired offset from the material edge. With prior devices, it was not generally possible to obtain better than plus one-half stitch accuracy in case the exact starting point was not obtained during sewing. Even when the exact starting point is obtained, due to material stretching and the like, inaccuracies relative to the desired offset from the material edge often occur in actual sewing.

FIG. *6c* illustrates the sewing of the seam wherein the seam ended approximately one-half stitch away from the desired offset from the material edge. In the previously noted example, the ending of the seam shown in FIG. *6c* might be three-eighths inch away from the material edge rather than the desired one-fourth inch from the material edge.

It will be understood that the examples shown in FIGS. *6a–6c* provided an accuracy of plus or minus one-half stitch length because it was not possible to vary the length of the stitch. In accordance with the present operation, the length of a stitch may be varied in order to provide greater accuracy. Such improved accuracy is required in certain sewing operations, such as top stitched collars, in order to provide the desired visual characteristics of the garment.

FIGS. *7a–7b* illustrate operation of the present invention wherein accuracy of plus or minus one-fourth stitch may be provided. In accordance with the present invention, the edge detector described and shown in FIGS. 1–3 detects the edge of the material in order that the seam length can be stopped at a given distance from the material edge. The present system is originally taught by the operator to sew a given number of stitches $y-x$ in a seam after the edge of the material is detected. When the operation is repeated in the automatic sewing mode, as described in the prior patent applications noted above, the system will sew until the edge is detected, and will then sew $y-x$ stitches before terminating the seam. Depending upon the percentage of the stitch which has been sewn at the time of detection of the material edge, the last stitch sewn may be varied in order to provide increased accuracy to this seam termination.

The present system provides the capability to sew a specified number x of stitches, a specified number of stitches plus one additional stitch $(x+1)$, or a specified number of stitches plus one-half additional stitch $(x+\frac{1}{2})$. An important aspect of the present invention is the ability to sew $x+\frac{1}{2}$ additional stitches by utilization of the reverse mechanism on the sewing machine as shown in FIG. 4.

The reverse mechanism operates in a linear fashion such that when then the mechanism is fully actuated as shown by position 17' in FIG. 4, a stitch is sewn in the reverse direction. The stitch length in the reverse direction will roughly correspond to the stitch length normally sewn in the forward direction when the lever is not depressed. If the reverse lever is approximately fifty percent depressed, the material is not advanced nor reversed during the stitch formation and a "condensed" stitch with zero length is formed. If the reverse lever 17 is moved only approximately twenty-five percent of its full range of movement, due to the positioning of the stop member 13, a forward stitch fifty percent of the normal stitch length is formed. Consequently, the addition of the stop member 13 causes a one-half length stitch to be sewn when the cylinder 21 actuates the reverse sew lever 17.

The controller 51 determines whether or not x, $x+\frac{1}{2}$ or $x+1$ additional stitches shall be taken after the sensor detects the material edge. The system periodically interrogates the edge sensor of the system during the formation of each stitch to determine if the sensor detects the material edge during the stitch. Sewing is continued until the sensor detects the edge. If the sensor detects the edge during the first twenty-five percent formation of the stitch being sewn, the system will sew x additional stitches after the current stitch is completed. If the sensor detects the edge of the material in the interval of twenty-five to seventy-five percent formation of the stitch length, the system will sew $x+\frac{1}{2}$ additional stitches. If the sensor detects the material edge during the last twenty-five percent of the stitch length, the system will sew $x+1$ additional stitch.

The $x+\frac{1}{2}$ and $x+1$ stitch cases are alike in that the system sews $x+1$ additional stitchs in both cases. However, in the $x+\frac{1}{2}$ case, the reverse mechanism 17 is actuated during the final stitch with the reverse mechanism constrained by the stop 13 such that the lever 17 cannot travel more than approximately twenty-five percent of its maximum travel. This causes the last stitch to be approximately one-half the normal stitch length.

FIGS. *7a* and *7b* illustrate how operation of the present system can improve the accuracy of the seam end point. In FIG. *7a*, the seam was started at a point that the end of stitch 69 is slightly over ¼ stitch away from the desired offset. Thus, the last stitch is varied in length by ½ such that the seam ends within ¼ stitch of the desired offset. In FIG. *7b*, the length of the last stitch is also reduced by one-half such that the seam ends approximately one-fourth stitch length away from the desired offset from the material edge.

Figure 8:
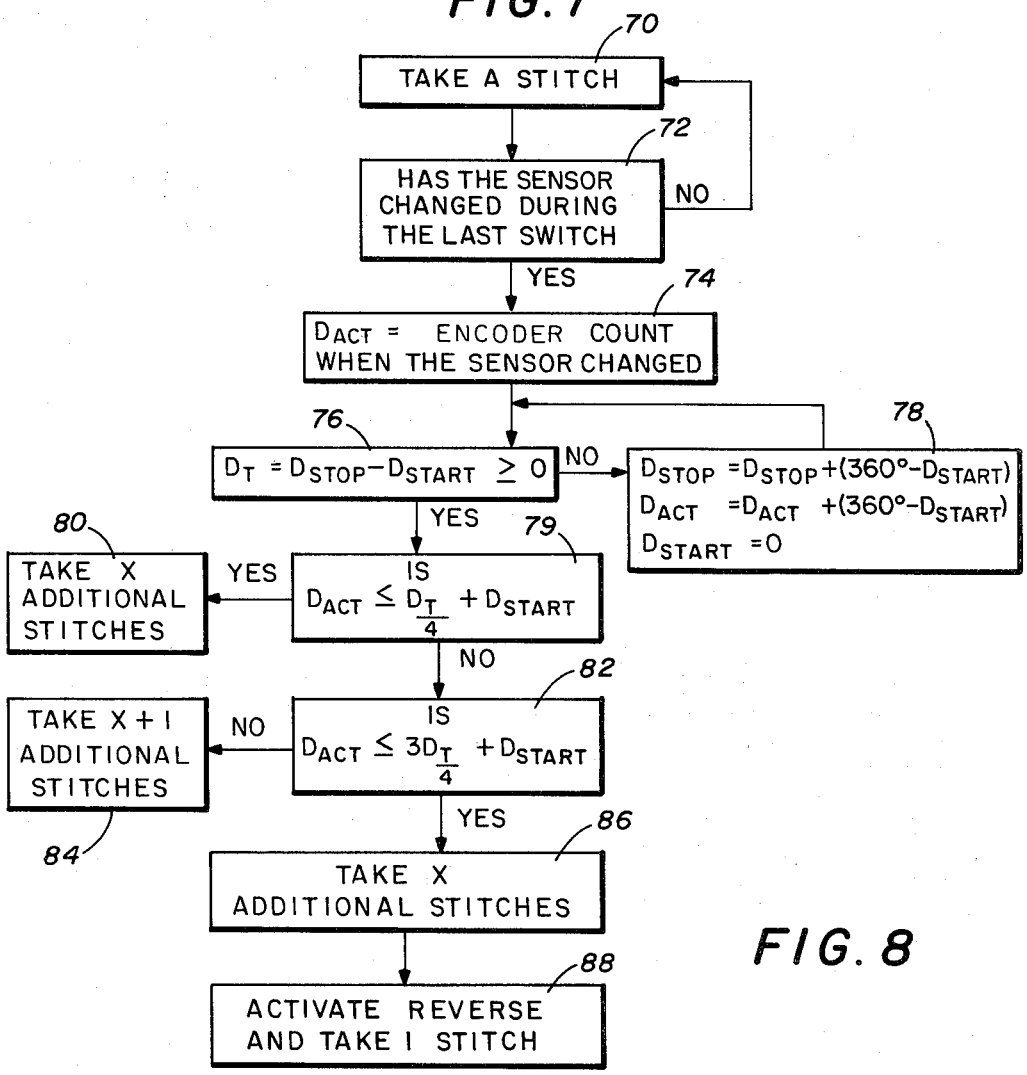
FIG. 8 is a flow chart illustrating the operation of the present invention to provide plus and minus one-fourth stitch accuracy.

FIG. 8 illustrates a flow diagram illustrating the operation of the present invention. The steps are implemented by suitable programming of the microprocessor controller 51. The program is suitable for adaptation to the Zylog Z-80 microprocessor and may be written into Z-80 assembly language in a manner known to the art.

At step 70, one stitch is taken. A determination is made at step 72 as to whether or not the edge sensor shown in FIGS. 2 and 3 has changed state during the last switch. If not, another stitch is taken at step 70. If it is determined that the sensor has changed during the last stitch, thereby indicating the detection of the material edge, $D_{act}$ is set in a register at step 74. $D_{act}$ is equal to the encoder count which represents the motor rotation angle when the sensor changed.

At step 76, a determination is made by the program as to whether or not $D_{stop}-D_{start}$ is greater than or equal to zero. $D_{start}$ equals the encoder count value when the stitch movement begins. $D_{stop}$ equals the encoder count value when the stitch movement ends. If the decision at step 76 is no, the motor angle values $D_{act}$, $D_{stop}$ and $D_{start}$ are adjusted at step 78 for numerical analysis reasons. Specifically, steps 76 and 78 are provided to enable the system to accommodate various machines having different feeding intervals during the rotation of the motor. At step 78, $D_{start}$ is set to zero, $D_{stop}$ is set to $D_{stop}+(360°-D_{start})$ and $D_{act}$ is set to $D_{act}+360°-D_{start})$.

If $D_{stop}-D_{start}$ is greater than or equal to zero, the determination is made at step 79 as to whether or not $D_{act}$ is less than or equal to $D_{T/4}+D_{start}$. In other words, the decision is made at step 79 as to whether or not the material edge was detected when the stitch was less than twenty-five percent completed. If the answer is yes, x additional stitches are taken by the system at step 80. If the edge of the material was not detected within the first one-quarter of the stitch length, a decision is made at step 82 as to whether or not $D_{act}$ is less than or equal to $3D/4T+D_{stop}$. In other words, a decision is made at step 82 as to whether or not the material edge was detected in the last twenty-five percent of the stitch. If so, x+1 additional stitches are taken at step 84 by the system.

If it is determined at steps 78 and 82 that the material edge was detected between twenty-five percent and seventy-five percent of the completion of the switch, x additional stitches are taken at step 86 and then the reverse mechanism is actuated at step 88 and one additional stitch is taken. This provides an additional one-half stitch to provide improved accuracy to the system.

It will be understood that the reverse mechanism could be actuated a greater or lesser amount than approximately twenty-five percent in order to decrease or increase the length of the stitch taken by the system. Moreover, it will be understood that instead of decreasing the last stitch length by one-half, the last two stitches could be reduced in length to three-fourths of their original length. Other variations involving reduction of the length of the stitch by movement of the reverse lever for predetermined amounts will be accomplished by the present invention.

It will thus be seen that the present system periodically interrogates the edge sensor as stitches are being formed in order to determine the state of formation of a stitch when the edge of the material is detected. Depending upon the amount of stitch formed at the time of edge detection, a predetermined number of additional stitches plus one stitch if necessary are taken by the system with the length of one or more of the stitches varied in order to provide improved accuracy.

Whereas the present invention has been described with respect to specific embodiments thereof, it will be understood that various changes and modifications will be suggested to one skilled in the art, and it is intended to encompass such changes and modifications as fall within the scope of the appended claims.

We claim:

1. In a sewing machine having a reciprocable needle for stitching seams in material, seam length control apparatus comprising:

means for detecting a material discontinuity in advance of a seam;

means for controlling the reciprocable needle to sew a variable number of stitches after said detecting means detects said material discontinuity; and means responsive to said detecting means for varying the amount of completion of only the last seam stitch by a variable amount depending upon what percentage of a stitch has been taken when the predetermined material discontinuity is detected.

2. The seam length control apparatus of claim 1 wherein said means for varying the length of the last seam stitch comprises:

means for determining the amount of completion of the stitch being sewn at the time of detection of said predetermined material discontinuity.

3. The seam length control apparatus of claim 2 and further comprising:

means responsive to said determining means for operating the reverse mechanism of the sewing machine to control the length of the last seam stitch.

4. The seam length control apparatus of claim 2 wherein no adjustment to the length of the last seam stitch is made if no more than one-fourth the length of the stitch being sewn is complete at the time of detection of said predetermined material discontinuity.

5. The seam length control apparatus of claim 2 wherein the reverse mechanism of the sewing machine is operated to reduce the length of the last seam stitched if between twenty-five and seventy-five percent of the stitch being sewn is complete at the time of detection of said material discontinuity.

6. The seam length control apparatus of claim 2 wherein a full stitch is added to said number of stitches if more than seventy-five percent of the stitch being sewn is complete at the time of detection of said predetermined material discontinuity.

7. A seam length control apparatus for use on a machine having a reciprocable stitching member comprising:

means for detecting the edge of the material in advance of the seam being stitched, means for detecting the amount of completion of the stitch being formed at the time of detection of the edge of the material, and means responsive to said detecting means for varying the length of only the last stitch formed in the seam by a variable amount.

8. The apparatus of claim 7 wherein no adjustment of the length of the last seam stitch is made if no more than one-fourth the length of the stitch being formed is complete at the time of detection of said predetermined material discontinuity.

9. The apparatus of claim 7 wherein the reverse mechanism of the machine is operated to reduce the length of the last stitch if between twenty-five and seventy-five percent of the stitch being formed is complete at the time of detection of said edge.

10. The apparatus of claim 7 and further comprising:

means for controlling said stitching member to sew a variable number of stitches after said detecting means detects said edge of material, wherein a full stitch is added to said seam if more than seventy-five percent of the stitch being formed is complete at the time of detection of said edge.

11. The apparatus of claim 7 and further comprising:

means responsive to said detecting means for operating the reverse mechanism of the machine in order to reduce the length of the last stitch formed in the same.

12. The apparatus of claim 11 wherein the reverse mechanism of the machine is moved less than its full range of movement such that the stitch formed is approximately one-half the length of the normal stitch.

13. A seam length control apparatus for use with a sewing machine having a reciprocable needle and a reversing mechanism comprising:

means for detecting the edge of the material being sewn in advance of the seam;

means for controlling the reciprocable needle to sew a variable number of stitches after said detecting means detects the edge of the material;

means for determining the length of the stitch being sewn at the time of detection of the edge of the material; and means responsive to said determining means for operating the reverse mechanism of the sewing machine in a limited manner such that the length of only the last stitch sewn in the seam is less than the length of the remainder of the stithces in the seam.

14. The seam length control apparatus of claim 13 wherein no adjustment to the length of the last seam stitch is made if no more than one-fourth the length of the stitch being sewn is complete at the time of detection of said predetermined material discontinuity.

15. The seam length control apparatus of claim 13 wherein the reverse mechanism of the sewing machine is operated to reduce the length of the last stitch if between twenty-five and seventy-five percent of the stitch being sewn is complete at the time of detection of said predetermined material discontinuity.

16. The seam length control apparatus of claim 13 wherein a full stitch is added to said number of stitches if more than seventy-five percent of the stitch being sewn is complete at the time of detection of said predetermined material discontinuity.

17. The apparatus of claim 13 wherein said means for operating the reverse mechanism of the sewing machine comprises:

means for moving the reverse mechanism of the sewing machine between a de-energized and an energized position; and stop means provided to limit said energized position to less than full energization in order to reduce the length of the stitch being sewn.

18. The apparatus of claim 17 wherein said means for moving comprises a pneumatic cylinder arm connected to the reverse mechanism of the sewing machine.

19. The apparatus of claim 3 and further comprising:

means for automatically operating the reverse mechanism of the sewing machine; and means for automatically limiting the movement of the reverse mechanism of the sewing machine to a predetermined position in order to reduce the length of the stitch being sewn to a predetermined length.

20. The apparatus of claim 19 wherein said means for limiting limits the movement of the reverse mechanism to approximately one-fourth its normal range of operation such that the length of the stitch being sewn is approximately one-half that of the length of a normal stitch.

21. The appartus of claim 19 wherein said means for operating is dependent upon detection of the edge of the material in advance of the seam being sewn.

22. The method of operating a sewing machine having a reciprocable needle for stitching seams in material, comprising:

detecting a material discontinuity in advance of a seam;

controlling the reciprocable needle to sew a variable number of stitches after said material discontinuity is detected; and varying the length of only the last seam stitch by a variable amount in response to the detection of said material discontinuity.

23. The method of claim 22 wherein said step of varying the length of the last seam stitch comprises:

determining the amount of completion of the stitch being sewn at the time of detection of said predetermined material discontinuity.

24. The seam length control method of claim 23 and further comprising:

operating the reverse mechanism of the sewing machine to control the length of the last seam stitch.

25. The method of claim 23 wherein no adjustment to the length of the last seam stitch is made if no more than one-fourth the length of the stitch being sewn is complete at the time of detection of said predetermined material discontinuity.

26. The method of claim 23 wherein the reverse mechanism of the sewing machine is operated to reduce the length of the last seam stitched if between twenty-five and seventy-five percent of the stitch being sewn is complete at the time of detection of said predetermined material discontinuity.

27. The method of claim 23 wherein a full stitch is added to said predetermined number of stitches if more than seventy-five percent of the stitch being sewn is complete at the time of detection of said predetermined material discontinuity.

28. The method of operating a sewing machine having a reciprocable needle comprising:

detecting the edge of the material being sewn in advance of the seam being sewn;

detecting the amount of completion of the stitch being sewn at the time of detection of the edge of the material; and varying the amount of completion of only the last stitch sewn in the seam by a variable amount in response to the detected amount of completion of the stitch.

29. The method of controlling seam length with a sewing machine having a reciprocable needle and a reversing mechanism comprising:

detecting the edge of the material being sewn in advance of the seam;

controlling the reciprocable needle to sew a variable number of stitches after the edge of the material is detected;

determining the length of the stitch being sewn at the time of detection of the edge of the material; and responsive to said determining, operating the reverse mechanism of the sewing machine in a limited manner such that only the last stitch sewn in the seam is less than the length of the remainder of the stitches in the seam.

* * * * *

UNITED STATES PATENT AND TRADEMARK OFFICE

CERTIFICATE OF CORRECTION

PATENT NO. : 4,404,919

DATED : September 20, 1983

INVENTOR(S) : Charles R. Martell, et al.

It is certified that error appears in the above—identified patent and that said Letters Patent is hereby corrected as shown below:

Col, 1, line 11, "filed July 4, 1980" should be --filed July 14, 1980--.

Figure 6:
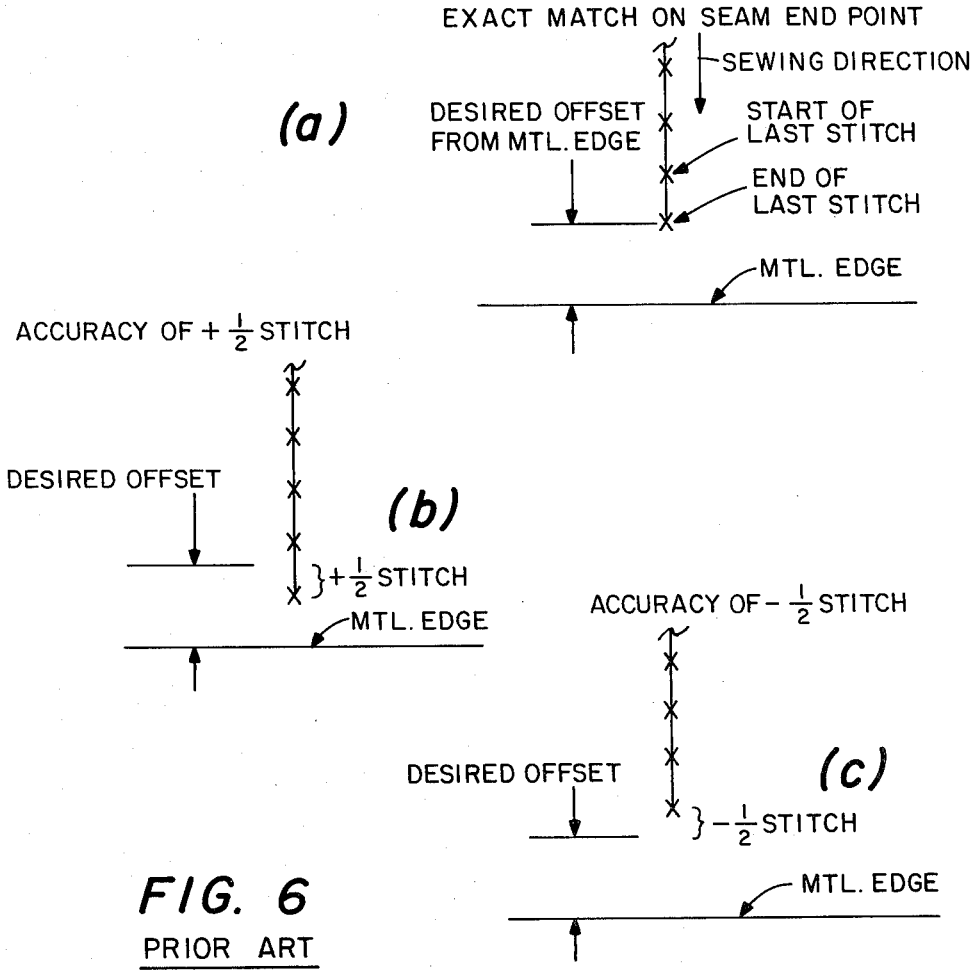
FIG. 6 PRIOR ART
FIG. 6*a* illustrating the prior art sewing of a seam wherein the end of the last stitch ends exactly at the desired offset from the edge of the material.
FIG. 6*b* illustrates a graphical representation of the prior art sewing of a seam wherein the end of the last stitch passes the desired offset from the material edge by one-half stitch length.
FIG. 6*c* is a graphical illustration of the prior art sewing of the seam wherein the end of the last stitch terminates approximately one-half stitch length from the desired offset from the material edge.
Figure 7:
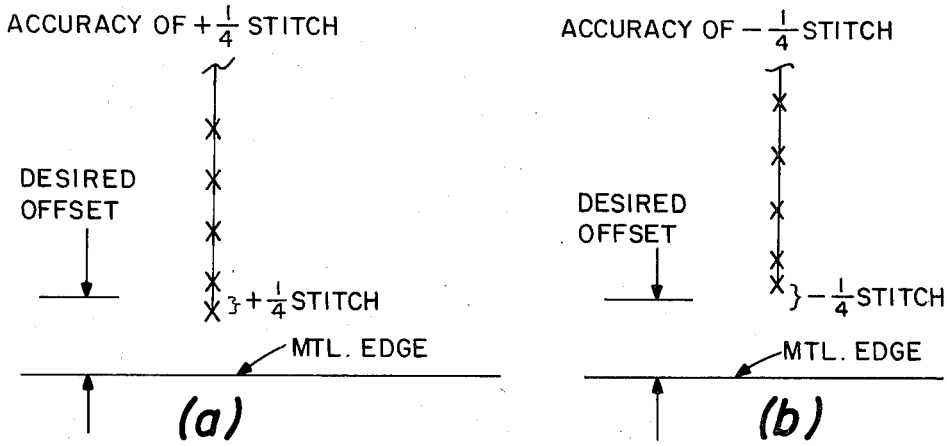
FIG. 7*a* is a graphical illustration illustrating the sewing of a seam in accordance with the present invention in which the end of the last stitch terminates approximately one-fourth stitch length past the desired offset from the material edge.
FIG. 7*b* is a graphical illustration of the present invention wherein the end of a last stitch terminates approximately one-fourth stitch away from the desired offset from the material edge.

Col. 3, line 20, "including edge" should be --indicating edge--;

line 23, "edge in monitored" should be --edge is monitored--;

line 46, "FIG 6a illustrating" should be --FIG. 6a is a graph illustrating--.

Col. 5, line 43, "having" should be --have--;

line 48, "pressure or absence" should be --presence or absence--.

Col. 11, line 48, "stithces" should be --stitches--.

Signed and Sealed this

*Twenty-first* Day of *February* 1984

[SEAL]

*Attest:*

GERALD J. MOSSINGHOFF

*Attesting Officer*

*Commissioner of Patents and Trademarks*